United States Patent [19]

Witczak

[11] Patent Number: 4,760,789

[45] Date of Patent: Aug. 2, 1988

[54] ADJUSTABLE ROLLER SYSTEM FOR PRINTING OR DUPLICATING MACHINES

[75] Inventor: Stanley Witczak, Chicago, Ill.

[73] Assignee: AM International, Inc., Chicago, Ill.

[21] Appl. No.: 884,241

[22] Filed: Jul. 10, 1986

[51] Int. Cl.[4] ..... B41F 13/20; B41F 13/26; B41F 13/36

[52] U.S. Cl. ..... 101/348; 101/349; 101/247; 100/168; 100/171; 384/258; 384/583

[58] Field of Search ..... 101/247, 348–350, 101/352; 384/247, 253, 256, 258, 259, 519, 583; 68/257, 258, 260, 262 R; 100/168, 169, 171; 400/352, 354, 354.3, 355

[56] References Cited

U.S. PATENT DOCUMENTS

| | | | |
|---|---|---|---|
| 915,553 | 3/1909 | Church | 384/247 |
| 1,044,127 | 11/1912 | Boyer | 100/168 |
| 1,167,375 | 1/1916 | Brock | 384/258 |
| 2,163,374 | 6/1939 | Crafts | 101/349 |
| 2,751,843 | 6/1956 | Faeber | 101/349 |
| 2,860,579 | 11/1958 | Granger | 101/348 |
| 2,868,122 | 1/1959 | Faeber | 101/348 |
| 3,246,601 | 4/1966 | Fischer | 101/350 |
| 3,552,313 | 1/1971 | Jeschke | 101/247 |
| 3,845,708 | 11/1974 | Liebert | 100/168 |
| 4,077,316 | 3/1978 | Georget | 100/169 |

*Primary Examiner*—William Pieprz

*Attorney, Agent, or Firm*—Nicholas A. Camasto; John R. Hoffman

[57] ABSTRACT

An adjustable mounting mechanism for a distribution roller in a printing, duplicating or like machine which includes a moisture or ink system having a plurality of distribution rollers for distributing moisture or ink to a printing couple of the machine. A pair of fixed rollers and a removable roller are located on the machine in a triangular configuration with parallel axes of rotation. The adjustable mounting mechanism includes a triangulated array of pivot arms movable generally perpendicular to the axes of the rollers. Two of the pivot arms define a V-shaped yoke to cradle the removable roller, and the other pivot arm defines a clamp for holding the removable roller in the cradle. Each of the other two pivot arms and, therefore, the removable roller is adjustable generally radially toward and away from the respective fixed roller to adjust the pressure or gap between the removable roller and the respective fixed roller. The clamp arm is spring loaded to permit adjustment of the other two pivot arms and, therefore, the removable roller while the removable roller is held by the clamp arm.

15 Claims, 1 Drawing Sheet

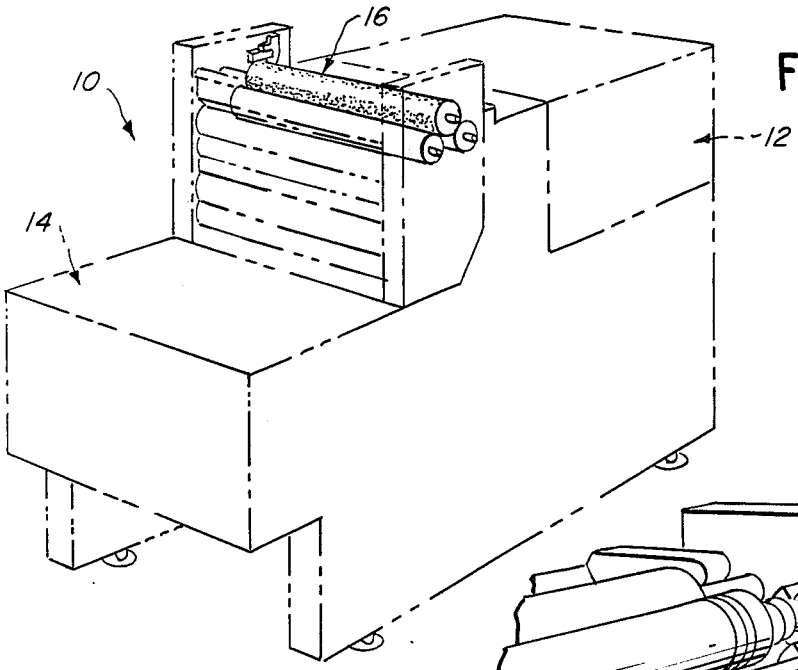
FIG. 1
FIG. 2
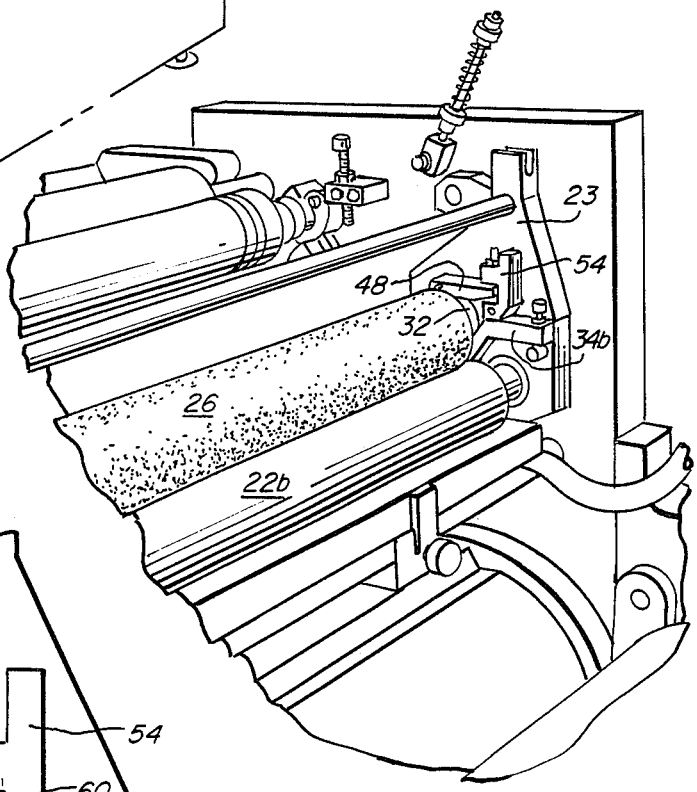
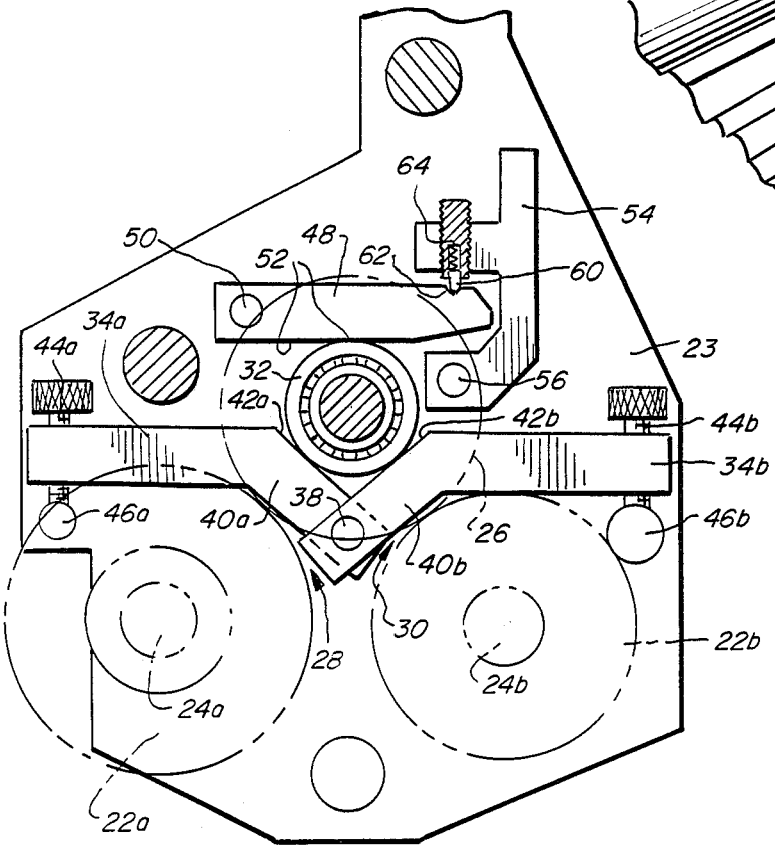
FIG. 3

ADJUSTABLE ROLLER SYSTEM FOR PRINTING OR DUPLICATING MACHINES

BACKGROUND OF THE INVENTION

This invention generally relates to printing or duplicating machines and, more particularly, to a system or mechanism for adjustably mounting distribution rollers for distributing moisture or ink to the printing couple of the machine.

Printing machines normally include a printing couple which comprises a number of cylinders and/or rollers such as impression cylinders, master cylinders, blanket cylinders, ductor rollers, transfer rollers, regulator rollers, and the like. For instance, an ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers which can be generally termed "distribution" rollers are provided between the moisture fountain and/or ink fountain for distributing moisture and/or ink to the printing couple of the machine.

The distribution rollers often are mounted in triangulated arrays, i.e. groups of three, whereby one roller defines distribution gaps with two other adjacent rollers. Throughout the complex system of rollers, the "gaps" or pressure between adjacent rollers must be capable of regulation or adjustment in order to regulate the flow of moisture or ink through the roller system to the printing couple. When a given roller is disposed for conjoint rotation with a pair of adjacent rollers to distribute moisture or ink in a path therebetween, it is most desirable to provide for adjustment of the single roller in at least two directions so that pressure between that roller and its adjacent rollers can be adjusted by regulating the single roller.

Heretofore, roller adjustment mechanisms have been extremely complicated. Often, the machine must be shut down in order to perform any adjustments. In some instances, one or more of the rollers may have to be removed, particularly the adjustable roller, in order to accomplish any adjustments.

It would be desirable to provide a pressure adjustment mechanism which is simple, effective and which can be adjusted to vary the pressure or "gap" between adjacent rollers without removing any single roller. This invention is directed to solving the above problems and satisfying such a need for a simple adjustment mechanism for the distribution rollers, which can be performed while the rollers are in position and still allowing removal of the adjustable roller.

SUMMARY OF THE INVENTION

An object, therefore, of the invention is to provide a new and improved system for mounting and adjusting a distribution roller in a printing, duplicating or like machine which includes a moisture or ink distribution system.

In the exemplary embodiment of the invention, a pair of spaced, fixed rollers are mounted on the machine for rotation about generally parallel axes. A removable roller is positionable in a triangular configuration in juxtaposition to the spaced, fixed rollers to define moisture distribution gaps between the removable roller and each spaced roller. Adjustable mounting means are provided for receiving and positioning the removable roller relative to the fixed, spaced rollers.

Generally, the adjustable mounting means include a triangulated array of pivot arms movable generally perpendicular to the axes of the rollers. Two of the pivot arms define a cradle for receiving the removable roller. The other pivot arm defines a clamp for holding the removable roller in the cradle. Means are provided for independently adjusting each of the two arms and, therefore, the removable roller generally radially toward and away from the respective fixed roller to adjust the pressure or gap between the removable roller and the respective fixed roller.

More particularly, the adjustable mounting means include a pair of adjustable lever arms forming a V-shaped yoke for receiving and positioning the removable roller. Each adjustable lever arm has at least a portion thereof extending generally tangentially of a respective one of the spaced, fixed rollers. The V-shaped yoke is defined by the tangentially extending portions of the adjustable lever arms, the arms being pivotally mounted on a common pivot axis located equidistant between the pivot axis of the spaced, fixed rollers.

The clamp arm is spring loaded to permit adjustment of the adjustable lever arms and, therefore, the removable roller while the removable roller is received and positioned in the V-shaped yoke. The clamp arm is in the form of a third lever pivotally mounted on fixed pivot axis for engaging the adjustable roller tangentially at a point located on a line passing equidistant between the spaced, fixed rollers and through the common pivot axis of the adjustable lever arms. A fourth lever arm has a latch portion for engaging the third, clamp lever arm at a location spaced from its pivot axis to hold the clamp arm against the removable roller. The aforesaid spring loading of the clamp arm is provided by spring means operatively associated between the clamp arm and the fourth or latch arm.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic perspective view of a printing or duplicating machine in which the invention is applicable;

FIG. 2 is a perspective view, on an enlarged scale, illustrating various cylinders and rollers of the machine, and including the adjustable roller mounting means of the invention; and FIG. 3 is a transverse section, on a further enlarged scale, through three rollers and illustrating the components of the adjustable mounting means for the removable roller.

DETAILED DESCRIPTION OF THE PREFERRED EMBODIMENT

Referring to the drawings in greater detail, and first to FIG. 1, the invention is illustrated herein for use in a printing, duplicating or like machine, generally designated 10, which includes a sheet feeding end, generally designated 12, and an imaged copy exiting end, generally designated 14. The copy sheets which have images produced on one or both sides are stacked at exiting end 14 as is conventional with most printing or duplicating machines. The machine includes at least one printing couple, generally designated 16, which includes the conventional impression cylinders, blanket cylinders and master or plate cylinders. Usually, the printing couple includes one impression cylinder, one blanket cylinder and one master or plate cylinder.

Printing or duplicating machine 10 may be such as a rotary offset lithographic machine and includes an ink fountain for feeding ink to various distribution rollers of the printing couple which transfers images to copy sheets. In addition, a moisture fountain is disposed adjacent the printing couple for feeding moisture to the printing couple through a path defined by various ductor rollers, regulator rollers, transfer rollers, and the like. This invention is directed to a new and improved, greatly simplified mounting mechanism or system for removably and adjustably mounting a roller in the moisture or ink distribution system of the machine.

More particularly, referring to FIGS. 2 and 3, the system is illustrated with a pair of spaced rollers 22*a* and 22*b* mounted for rotation on the machine (conventionally between a pair of side frame panels 23) for rotation about generally parallel, fixed axes defined by shafts 24*a* and 24*b*, respectively. A removable roller 26 is positionable by adjustable mounting means (described hereinafter) in juxtaposition to spaced, fixed rollers 22*a* and 22*b* to define moisture distribution "gaps" between the removable roller and each fixed roller, as indicated generally by arrows 28 and 30 for rollers 22*a* and 22*b*, respectively.

It should be understood immediately that the term "gaps" herein is meant to designate paths between adjacent rollers through which the moisture travels to the printing couple. In fact, the gaps are extremely small and the invention actually is directed to regulating the pressure between removable roller 30 and fixed rollers 22*a*, 22*b*. Furthermore, as might be used hereinafter and in the claims, the components of the adjustable mounting means may be defined as acting upon or engaging adjustable roller 26. However, as illustrated herein, adjustable roller 26 includes a bearing 32 at each opposite end and which is the portion of the adjustable roller which is acted upon by the adjustable mounting means.

The adjustable mounting means of this invention include a pair of adjustable lever arms 34*a* and 34*b* which are mounted on the machine (i.e. a frame panel 23) by means of a common pivot axis or pin 38. It can be seen that the pivot axis is located equidistant between the pivot axes 24*a*, 24*b* of fixed rollers 22*a*, 22*b*. Lever arms 34*a* and 34*b* have tangentially extending portions 40*a* and 40*b* which form a V-shaped yoke or cradle defined by a surface 42*a* of portion 40*a* and a surface 42*b* of portion 40*b*. In essence, surface 42*a* extends generally tangentially, or perpendicular to a radius, of fixed roller 22*a*. Surface 42*b* extends generally tangentially, or perpendicular to a radius of fixed roller 22*b*.

Means are provided for independently adjusting each lever arm 34*a*, 34*b* to move surfaces 42*a*, 42*b* and, therefore, removable roller 26 generally radially toward and away from the respective fixed roller 22*a*, 22*b*. More particularly, manually rotatable adjustment screw members 44*a* and 44*b* are threaded through the distal ends of lever arms 34*a* and 34*b*, respectively. Stop members or pins 46*a* and 46*b* project inwardly from frame 36 to define abutment stops for the distal ends of threaded screws 44*a*, 44*b*. Consequently, rotation of the adjustment screws pivot lever arms 34*a*, 34*b* about common pivot axis 38. This moves surfaces 42*a*, 42*b* generally radially toward and away from fixed rollers 22*a*, 22*b*. Since removable roller 26 is cradled between surfaces 42*a*, 42*b*, the roller can be moved in either direction toward and away from the respective fixed roller by independent adjustment of screw members 44*a* 44*b*.

Clamp means are provided for holding removable roller 26 in proper position within the cradle or V-shaped yoke defined by surfaces 42*a* and 42*b* of lever arms 34*a* and 34*b*, respectively. More particularly, a third or clamp lever arm 48 is pivotally mounted on a fixed pivot axis defined by a pivot pin 50 projecting from frame 36. It can be seen that clamp arm 48 engages removable roller bearing 32 at a point 52 located on a line passing equidistant between fixed rollers 22*a*, 22*b* and through the common pivot axis 38 of adjustable lever arms 34*a*, 34*b*. This is accomplished by a surface 52 of clamp arm 48 which extends generally tangentially to removable roller bearing 32 at point 52.

Clamp arm 48 is held in engagement with bearing 32 by a latch lever arm 54 pivotally mounted to frame panel 23 at a pivot axis defined by a pivot pin 56. Latch arm 54 is operatively associated with clamp arm 48 by a spring loaded mechanism to permit adjustment of lever arms 34*a*, 34*b* and, therefore, removable roller 26 while the removable roller is positioned in the V-shaped yoke defined by surfaces 42*a*, 42*b*.

To this end, a pin 60 engages within a notch 62 on the top of clamp arm 48. Pin 60 is spring loaded by a coil spring 64 to bias clamp arm 48 against removable roller bearing 32. Therefore, constant pressure engagement is applied to removable roller 26 to apply a constant and equal pressure to both fixed rollers 22*a* and 22*b* regardless of the position of lever arms 34*a*, 34*b* as affected by adjustable screw members 44*a*, 44*b*.

From the foregoing, it can be seen that the adjustable mounting means of this invention, for removable roller 26, not only provides for independent adjustment of the removable roller with respect to either fixed roller 22*a*, 22*b*, but the triangulated configuration of the lever arms provide for uniform pressures throughout the system in all directions.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing, duplicating or like machine which includes a fluid system having a plurality of distribution rollers for distributing fluid to the printing couple of the machine, the system comprising:

a pair of spaced rollers rotatably mounted for rotation about a generally parallel, fixed axes;

a removable roller positionable by adjustable mounting means in juxtaposition to the spaced rollers to define fluid distribution gaps between the removable roller and each spaced roller, the adjustable mounting means including a pair of adjustable members forming a V-shaped yoke for receiving and positioning the removable roller, each of said adjustable members being pivotably mounted for adjusting movement independent of each other, and each adjustable member having at least a portion thereof extending generally tangentially of a respective one of said spaced rollers, means for independently adjusting each adjustable member to move the tangentially extending portion thereof and, therefore, the removable roller generally radially toward and away from the respective spaced roller, and clamp means for holding the removable roller in the V-shaped yoke.

2. The system of claim 1 wherein said V-shaped yoke is defined by the tangentially extending portions of said adjustable members.

3. The system of claim 2 wherein said clamp means are spring loaded to permit adjustment of the adjustable members and, therefore, the removable roller while the removable roller is positioned in the V-shaped yoke.

4. In a printing, duplicating or like machine which includes a fluid system having a plurality of distribution rollers for distributing fluid to the printing couple of the machine, the system comprising:

a pair of spaced rollers rotatably mounted for rotation about generally parallel, fixed axes;

a removable roller positionable by adjustable mounting means in juxtaposition to the spaced rollers to define fluid distribution gaps between the removable roller and each spaced roller, the adjustable mounting means including a pair of adjustable members in the form of a lever arms pivotally mounted on a common pivot axis located equidistant between the fixed axis of the spaced rollers, the adjustable members having tangentially extending portions forming a V-shaped yoke for receiving and positioning the removable roller, each adjustable member having at least a portion thereof extending generally tangentially of a respective one of said spaced rollers, means for independently adjusting each adjustable member to move the tangentially extending portion thereof and, therefore, the removable roller generally radially toward and away from the respective spaced roller, and clamp means for holding the removable roller in the V-shaped yoke.

5. The system of claim 4 wherein said adjusting means are operatively associated with the lever arms at locations spaced from said common pivot axis.

6. The system of claim 5 wherein said adjusting means include manually rotatable screw members threaded through the lever arms, the distal ends of the screw members being in abutting relation with fixed stop members on the machine.

7. In a printing, duplicating or like machine which includes a fluid system having a plurality of distribution rollers for distributing fluid to the printing couple of the machine, the system comprising:

a pair of spaced rollers rotatably mounted for rotation about generally parallel, fixed axes;

a removable roller positionable by adjustable mounting means in juxtaposition to the spaced rollers to define fluid distribution gaps between the removable roller and each spaced roller, the adjustable mounting means including a pair of adjustable members in the form of lever arms pivotally mounted on a common pivot axis located equidistant between the fixed axis of the spaced rollers, the adjustable members having tangentially extending portions forming a V-shaped yoke for receiving and positioning the removable roller, each adjustable member having at least a portion thereof extending generally tangentially of a respective one of said spaced rollers, means for independently adjusting each adjustable member to move the tangentially extending portion thereof and, therefore, the removable roller generally radially toward and away from the respective spaced roller, and clamp means for holding the removable roller in the V-shaped yoke, said clamp means being spring loaded to permit adjustment of the adjustable members and, therefore, the removable roller while the removable roller is positioned in the V-shaped yoke.

8. The system of claim 7 wherein said clamp means include a third lever arm pivotally mounted on a fixed pivot axis for engaging the adjustable roller tangentially at a point located on a line passing equidistant between the spaced rollers and through the common pivot axis of the adjustable lever arms.

9. The system of claim 8 wherein said clamp means include a fourth lever arm having a latch portion for engaging the third lever arm at a location spaced from its pivot axis to hold the third lever arm against the removable roller.

10. The system of claim 9 wherein said spring loading of the clamp means is provided by spring means operatively associated between the third lever arm and the fourth lever arm.

11. In a printing, duplicating or like machine which includes a fluid system having a plurality of distribution rollers for distributing fluid to the printing couple of the machine, the system comprising:

a pair of fixed rollers and a removable roller located on the machine in a triangular configuration with parallel axis of rotation; and adjusting mounting means for receiving and positioning the removable roller in juxtaposition to the fixed rollers to define adjustable fluid distribution gaps between the removable roller and each respective fixed roller, the adjustable mounting means including a triangular array of pivot arms movable generally perpendicular to the axes of the rollers, two of said pivot arms being pivotally mounted for adjusting movement independent of each other and defining a cradle for receiving the removable roller and the other pivot arm defining a clamp for holding the removable roller in the cradle, and means for independently adjusting each of said two arms and, therefore, the removable roller generally radially toward and away from the respective fixed roll to adjust the gap between the removable roller and the respective fixed roller.

12. The system of claim 11 wherein said clamp arm is spring loaded to permit adjustment of said other two arms and, therefore, the removable roller while the removable roller is held by the clamp arm.

13. In a printing, duplicating or like machine which includes a fluid system having a plurality of distribution rollers for distributing fluid to the printing couple of the machine, the system comprising:

a pair of fixed rollers and a removable roller located on the machine in a triangular configuration with parallel axes of rotation; and adjustable mounting means for receiving and positioning the removable roller in juxtaposition to the fixed rollers to define adjustable fluid distribution gaps between the removable roller and each respective fixed roller, the adjustable mounting means including a triangular array of pivot arms movable generally perpendicular to the axes of the rollers, two of said pivot arms being pivotally mounted on a common pivot axis located equidistant between the axis of rotation of the fixed rollers and defining a cradle for receiving the removable roller, and the other pivot arm defining a clamp for holding the removable roller in the cradle, the clamp arm being spring loaded to permit adjustment of said other two arms and, therefore, the removable roller while the removable roller is held by the clamp arm, and means for independently adjusting each of said two arms and, therefore, the removable roller generally radially toward and away from the respective fixed roller to adjust the gap between the removable roller and the respective fixed roller.

14. The system of claim 13 wherein said adjusting means are operatively associatd with said two adjustable arms at locations spaced from said common pivot axis.

15. The system of claim 14 wherein said adjusting means include manually rotatable screw members threaded through the arms, the distal ends of the screw members being in abutting relation with fixed stop members on the machine.

* * * * *